US005515414A

United States Patent [19]

d'Achard Van Enschut et al.

[11] Patent Number: 5,515,414

[45] Date of Patent: May 7, 1996

[54] X-RAY DIFFRACTION DEVICE COMPRISING COOLING MEDIUM CONNECTIONS PROVIDED ON THE X-RAY TUBE

[75] Inventors: Johannes F. M. d'Achard Van Enschut; Theodorus J. J. M. Jenneskens, both of Eindhoven, Netherlands

[73] Assignee: U.S. Philips Corporation, New York, N.Y.

[21] Appl. No.: 269,974

[22] Filed: Jul. 1, 1994

[30] Foreign Application Priority Data

Jul. 5, 1993 [EP] European Pat. Off. ..... 93201952

[51] Int. Cl.[6] ..... H01J 35/00

[52] U.S. Cl. ..... 378/141; 378/130; 378/200

[58] Field of Search ..... 378/119, 121, 378/127, 130, 141, 139, 136, 199, 200, 201

[56] References Cited

U.S. PATENT DOCUMENTS

| | | | |
|---|---|---|---|
| 4,866,749 | 9/1989 | Uematu | 378/134 |
| 4,969,173 | 11/1990 | Valkonet | 378/141 X |

FOREIGN PATENT DOCUMENTS

| | | | |
|---|---|---|---|
| 0293791 | 12/1988 | European Pat. Off. . | |
| 3827511 | 3/1989 | Germany . | |
| 0204337 | 8/1989 | Japan | 378/141 |
| 0187141 | 8/1991 | Japan | 378/141 |
| 0616717 | 7/1978 | U.S.S.R. . | |

OTHER PUBLICATIONS

Philips leaflet, "High Power X–ray Diffraction Tubes", pp. 1–11, No Date.

*Primary Examiner*—David P. Porta
*Attorney, Agent, or Firm*—Paul R. Miller

[57] ABSTRACT

An X-ray diffraction device comprises a water-cooled X-ray tube which exhibits a line focus as well as, after rotation through 90°, a point focus. Contrary to customary X-ray tubes, the cooling water is not supplied via the housing (12) in which the X-ray tube is mounted, but the cooling water connections (52, 54) are provided directly on the X-ray tube at the same side of the robe where the high-voltage connector (16) is provided. As a result, rotation of the robe upon changing over from a line focus to a point focus is not hampered by cooling water connections inside the housing of the tube. An additional advantage of this method of supplying the cooling water resides in the fact that the robe base (56) can also be cooled via these ducts. The base would otherwise become inadmissibly hot due to the loss heat from the filament (60).

5 Claims, 3 Drawing Sheets

X-RAY DIFFRACTION DEVICE COMPRISING COOLING MEDIUM CONNECTIONS PROVIDED ON THE X-RAY TUBE

The invention relates to an X-ray diffraction device, comprising an X-ray tube and a holder for accommodating the X-ray tube which comprises an anode which is cooled by means of a cooling medium and which is situated in the vicinity of a first end of the tube, which X-ray tube is adapted to produce a line-shaped X-ray focus with the device comprising conduit means for supplying and discharging the cooling medium.

The invention also relates to an X-ray tube for use in such a device.

BACKGROUND OF THE INVENTION

A device and a tube of the kind set forth are known from a leaflet published by Applicant and entitled "High Power X-ray Diffraction Tubes". The leaflet discloses an X-ray tube in which water is used as the cooling liquid for the anode. The conduit means for the supply and discharging of the cooling water comprise a cooling water inlet, denoted therein as "Water in" and a cooling water outlet which is denoted therein as "Water out", a duct which conducts the cooling water along the anode to be cooled being provided between the inlet and outlet. The inlet and the outlet are both provided in a flange arranged on the tube at the area of an end which is situated in the vicinity of the anode to be cooled. The X-ray tube is secured and positioned in the holder by means of the flange. The cooling water is supplied and discharged via openings in an abutment in the holder, which openings correspond to the inlet and the outlet in the flange. In the X-ray tube shown in this publication a line-shaped X-ray focus is formed wherefrom the radiation can be taken off in two mutually perpendicular directions, i.e. in the longitudinal direction of the focus and in a direction perpendicular thereto. For each of these directions an exit window is provided in the X-ray tube.

For some X-ray diffraction applications it is desirable to expose the specimen to be examined from a line-shaped focus, whereas for other applications a point-shaped focus is to be preferred. Therefore, the X-ray tube preferably provides both focus shapes. In the known X-ray tube this is possible by taking off the X-rays in the longitudinal direction of the focus line at a small angle relative to the anode surface; the line focus is then seen as a (virtual) point focus. When the X-rays are taken off in a direction perpendicular to the longitudinal direction, the X-ray focus is seen to be line-shaped. In practice the direction for the X-rays is prescribed, because this direction defines the location of the specimen, the detectors and the other equipment of the analysis apparatus. The desired switching-over from point focus to line focus and vice versa is then realised by rotating the X-ray tube in the holder through one quarter of a turn.

Rotation of the X-ray tube in its holder, however, has the drawback that after rotation the location of the openings in the abutment in the holder no longer registers with the inlet and the outlet in the flange of the X-ray tube. It would be feasible to solve this problem by providing an adapter flange between the flange of the tube and the abutment in the holder, i.e. one adapter flange for each position of the tube. The holes present in the abutment could then register once more with the holes in the tube flange. It is a drawback of this solution, however, that it requires separate components (the adapter flanges) and that such an exchange can be performed by skilled personnel only. It is a further drawback of this method of supplying water to the tube that a given amount of water is inevitably released near the high-voltage connector when the tube is detached for rotation. The water could cause high-voltage flash-overs which damage the connector and/or the X-ray tube.

SUMMARY OF THE INVENTION

It is an object of the invention to provide an X-ray diffraction device in which the X-ray tube can be rotated through 90° in the holder without requiring special steps and without causing leakage.

To achieve this, the device in accordance with the invention is characterized in that the conduit means comprise tubular ducts which extend from the first end to the other end of the X-ray tube.

During positioning the first end of the X-ray tube is slid into the holder so as to be secured therein. Its other end, where the supply cable for the high voltage and the filament current is secured, remains accessible to the operator. Because the cooling water connections are readily accessible at this area, the water tubes can be readily connected thereto. When the tube is rotated through 90°, the connection tubes simply move along.

It is to be noted that from the leaflet "Tubes for X-ray Spectrometry", published by Applicant, it is known per se to provide an X-ray tube with cooling water connections at the end facing the anode. However, it concerns an X-ray tube for spectrometry purposes and not for diffraction purposes. Thus, the tube shown therein is not adapted to produce a line focus and is not intended either to provide a point-shaped or a line-shaped X-ray focus in conformity with the required mode of operation.

In accordance with a further step of the invention, the device for X-ray diffraction is characterized in that the tubular ducts extend on the outer side of the X-ray tube. This substantially simplifies the construction of the tube. In accordance with a further step of the invention, the X-ray diffraction device is characterized in that the parts for high-voltage insulation of the tube are made of a ceramic material. These parts are customarily made of glass in known tubes. It is a known property of hand-made glass parts that they are liable to exhibit comparatively large dimensional tolerances. When use is made of a ceramic material, these parts can be manufactured with substantially smaller dimensional tolerances, resulting in smaller external dimensions of the tube. Space can then be readily reserved in the holder for the ducts for the cooling liquid.

Because the insulating parts of the tube are made of a ceramic material, a substantially more compact tube can be manufactured in comparison with glass-insulated tubes. This means that the path to be followed by the heat, developed by the filament (typically of the order of magnitude of 40 W), by conduction so as to reach the exterior of the tube is much smaller, whereas the thermal conduction of the ceramic material (for example, aluminium oxide, $Al_2O_3$) is substantially higher than that of glass. Consequently, it may occur that given tube parts, notably those where the high-voltage connector is provided, reach an inadmissibly high temperature so that they cause damage.

In order to avoid this situation, the device in accordance with the invention is characterized in that the cathode of the X-ray tube is mounted on a base of the X-ray tube via a ceramic intermediate member, and that the tubular cooling medium ducts extending on the outer side of the X-ray tube are mounted so as to be in thermal contact with the base. The high-voltage Connector is accommodated in a recess in the base; the base, and hence also the connector, is then cooled by the contacting cooling water ducts.

BRIEF DESCRIPTION OF THE DRAWINGS

The invention will be described in detail hereinafter with reference to the Figure in which corresponding elements are denoted by corresponding reference numerals. Therein.

DESCRIPTION OF THE INVENTION

Figure 1:
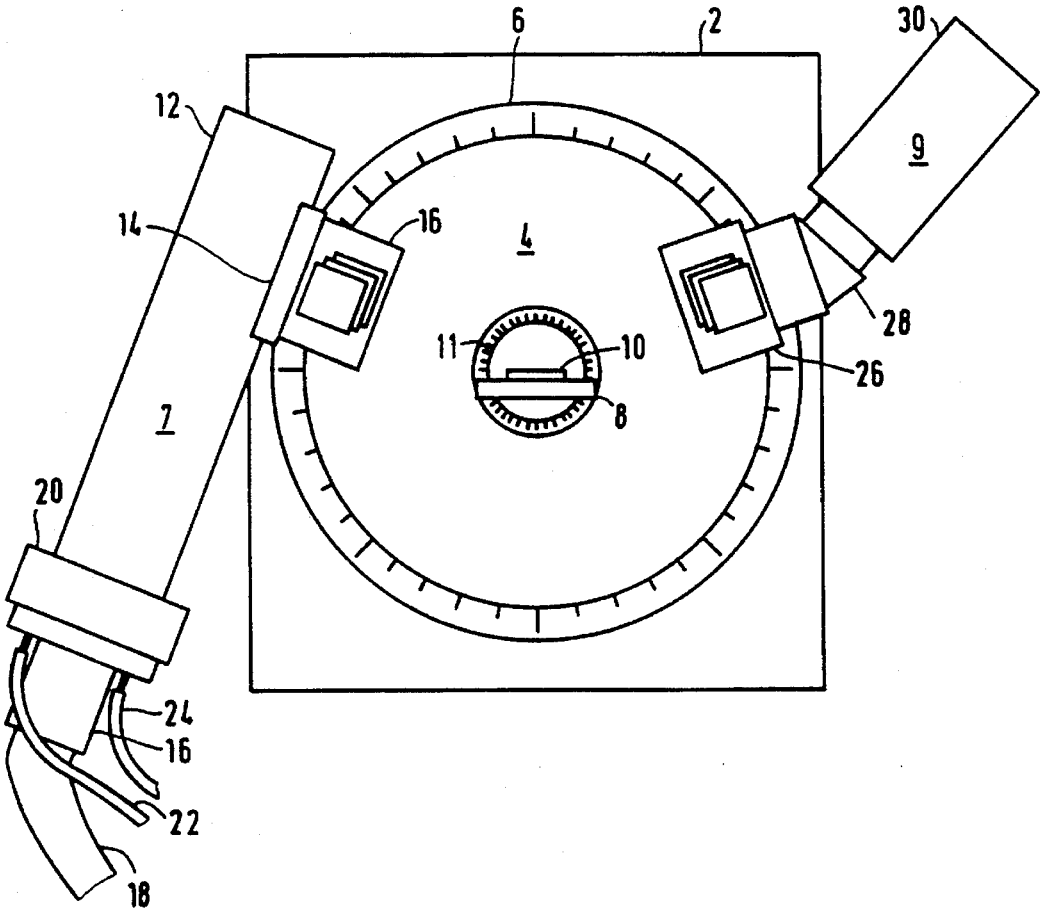
FIG. 1 shows diagrammatically an X-ray diffraction device in accordance with the invention.

FIG. 1 shows an X-ray diffraction device in which a goniometer 4 is mounted on a frame 2. The goniometer 4 is provided with a graduated scale 6 for measuring the angular rotation of the X-ray source 7 mounted thereon and of the detector device 9 which is also mounted thereon. The goniometer also comprises a specimen carder 8 on which a specimen 10 is provided. For cases where measurement of the angular rotation of the specimen is important, there is provided a graduated scale 11. The X-ray source 7 comprises a holder 12 for an X-ray tube which is not shown in this Figure and which is secured in the holder by way of a mounting ring 20. The X-ray tube is connected by a high-voltage connector 16 supplying the high-voltage and the filament current for the X-ray tube via a high-voltage cable 18. The inlet and outlet ducts 22 and 24 for the cooling water of the X-ray tube are provided at the same side of the X-ray tube. The tube holder 12 also comprises an X-ray exit window 14 and a unit 16 for collimating the X-ray beam (a Soller slit). The detector device 9 consists of a holder 26 for a Soller slit, a holder 28 for a monochromator crystal, and a detector 30. If the X-ray source as well as the detector are rotatable about the specimen, as shown in the Figure, it is not necessary to arrange the specimen so as to be rotatable. However, it is also possible to arrange the X-ray source so as to be immobile; this may be necessary in the event of large and heavy X-ray sources. In that case the specimen carrier as well as the detector should be rotatable.

Figure 2A:
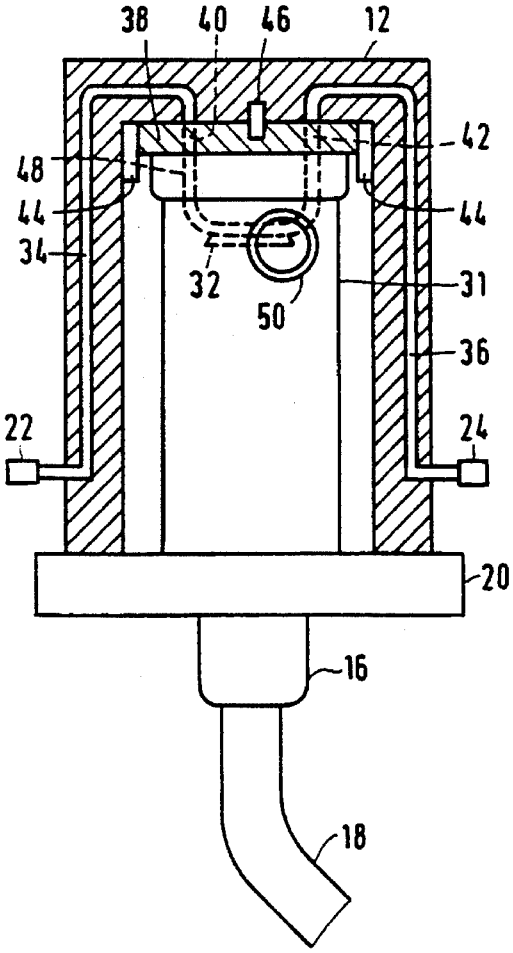
FIG. 2a PRIOR ART
FIG. 2*a* shows a holder with an X-ray tube in which cooling medium is supplied in known manner.
Figure 2B:
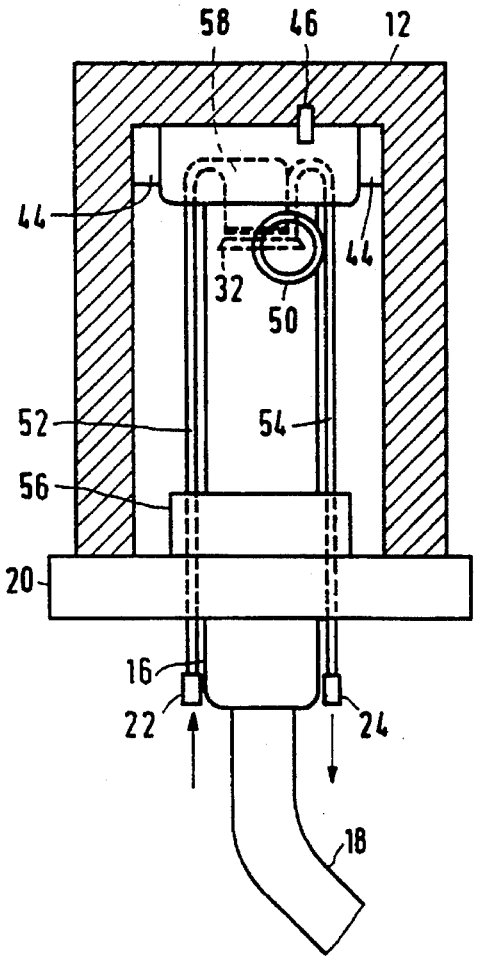
FIG. 2*b* shows a holder with an X-ray tube in which cooling medium is supplied in accordance with the invention.

FIGS. 2*a*and 2*b* show a holder with an X-ray robe; FIG. 2*a* shows how the cooling water is supplied in the known situation, whereas FIG. 2*b* shows how the cooling water is supplied according to the present invention.

FIG. 2*a* shows a holder 12 with an X-ray robe 31. The tube is positioned in the holder by way of a mounting flange 38 which cooperates with a rim 44 provided in the holder. The tube is placed in the correct angular position by way of a cam 46. The tube is secured in position by the mounting ring 20 which is clamped or screwed onto the holder 12. The X-ray tube 31 comprises an anode 32 which is to be cooled. The cooling water is conducted along the anode via ducts 34 and 36; these ducts form part of the holder 12. The cooling water is supplied via a connection 22 and is subsequently conducted, via a duct 34, to the flange 38 which is provided with two diametrically oppositely situated passages 40 and 42. In the X-ray tube, between these openings, there is provided a duct 48 via which the cooling water is conducted along the anode. On the anode 32 a line-shaped electron focus is formed so that a line-shaped or point-shaped X-ray focus is formed, depending on the take-off direction. The X-rays formed on the anode emanate from the holder via a window in the holder 12 (not shown in the Figure). The line-shaped focus emits the X-rays via a first window 50; the point-shaped focus is observed by observing the line-shaped focus in a direction perpendicular thereto, via a window (not shown in the FIG.) which has been rotated through 90° relative to the window 50. If X-rays are to be obtained from a (virtual) point-shaped source, the relevant window of the tube in the holder must be rotated so as to register with the holder window; in the case of a line-shaped focus, therefore, the robe must be rotated through 90°. Rotation of the tube in the holder is not possible unless special steps are taken, because the water connections in the holder 12 and the flange 40 no longer register after rotation. The invention offers a solution to this problem in the form of the embodiment shown in FIG. 2*b*.

In FIG. 2*b* cooling water is supplied to the anode 32 via two ducts 52 and 54 which extend around and outside the X-ray tube. These duets are thermally connected to the base 56. The ducts are connected to a cooling water reservoir 58 wherefrom the cooling water is distributed across the rear of the anode 32. If it is necessary to rotate the X-ray tube in the holder through 90°, the water connection problems as described with reference to FIG. 2*a* will not occur in this configuration.

Figure 3:
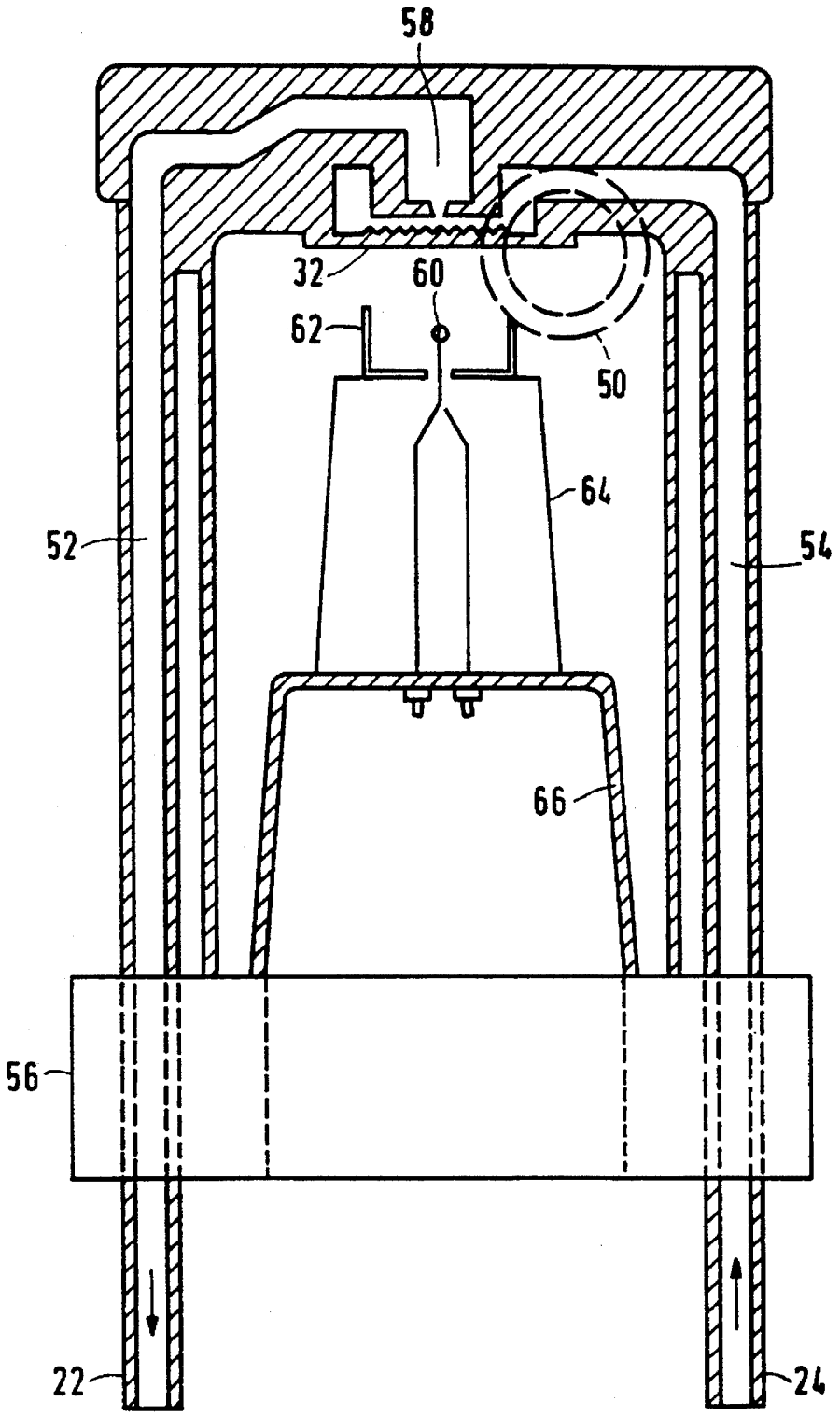
FIG. 3 shows an X-ray tube for use in an X-ray diffraction device as shown in FIG. 1.

FIG. 3 is a more detailed representation of an X-ray tube for use in an X-ray ray diffraction device. The tube comprises a filament 60 which is enclosed by a U-shaped cathode structure 62. Electrons emitted by the filament are accelerated by an electric field between the cathode and the anode and strike the anode with a high energy which is mainly converted into heat. A substantial part of the heat is dissipated by the cooling water transported through the ducts 52 and 54. The cathode 62 is mounted on a support 64 which itself is mounted on a ceramic intermediate member 66. This intermediate member is mounted on the base 56 which is traversed by the ducts 52 and 54. The heat produced by the filament 60 is to be discharged by convection or conduction. Because of the use of a ceramic material for the high-voltage insulation, there is a trend towards increasingly more compact X-ray tubes. The heat which must then be dissipated via the high-voltage insulation leads to higher temperatures of components on the outer side of the X-ray tube, such as the base 56. This is caused on the one hand by the shorter path between the filament 60 and the relevant component and on the other hand by the higher thermal conduction of the ceramic material in comparison with glass. Because cooling water is conducted along the base 56, this component cannot reach an inadmissibly high temperature.

We claim:

1. An x-ray diffraction device comprising an x-ray tube and holding means for accommodating said x-ray tube, said x-ray tube comprising (a) structure for producing a line-shaped x-ray focus, (b) an anode disposed in the vicinity of a first end of said X-ray tube, (c) cooling structure including conduit means for supplying and discharging cooling medium to said anode, said conduit means having tubular ducts extending from a second end of said x-ray tube, within said x-ray tube to a cooling liquid reservoir at a side of said anode at said first end.

2. An x-ray diffraction device according to claim 1, wherein said tubular ducts extend at outer sides of said x-ray tube adjacent to both said anode and a cathode structure of said x-ray tube.

3. An x-ray diffraction device according to claim 2, wherein said cathode structure is disposed at a base of said x-ray tube at said second end on an intermediate ceramic member contacting said base, said tubular ducts extending through said base to thermally cool said cathode structure.

4. An x-ray diffraction device according to claim 1, wherein high voltage insulation of said x-ray tube is ceramic material.

5. An x-ray tube comprising:

(a) structure for producing a line-shaped x-ray focus, (b) an anode disposed in the vicinity of a first end of said X-ray tube, (c) cooling structure including conduit means for supplying and discharging cooling medium to said anode, said conduit means having tubular ducts extending from a second end of said x-ray tube, within said x-ray tube, to a cooling liquid reservoir at a side of said anode at said first end.

* * * * *